United States Patent [19]

Isaksson

[11] 4,124,015

[45] Nov. 7, 1978

[54] DEVICE FOR CUTTING IN PARTICULAR REINFORCED CONCRETE PILES

[75] Inventor: Sven G. Isaksson, Landskrona, Sweden

[73] Assignee: AB Skanska Cementgjuteriet, Malmo, Sweden

[21] Appl. No.: 782,771

[22] Filed: Mar. 30, 1977

[30] Foreign Application Priority Data

Apr. 5, 1976 [SE] Sweden ..... 7603983

[51] Int. Cl.[2] ..... B28D 1/32

[52] U.S. Cl. ..... 125/23 R; 83/513; 144/34 E

[58] Field of Search ..... 138/97; 125/23 R; 83/513; 144/34 E

[56] References Cited

U.S. PATENT DOCUMENTS

| | | | |
|---|---|---|---|
| 247,569 | 9/1881 | Maxim | 125/23 R |
| 3,392,719 | 7/1968 | Clanton | 125/23 R |

FOREIGN PATENT DOCUMENTS

| | | |
|---|---|---|
| 1,759,391 | 6/1971 | Fed. Rep. of Germany. |
| 105,806 | 1/1965 | Norway. |

*Primary Examiner*—Harold D. Whitehead

*Attorney, Agent, or Firm*—Brumbaugh, Graves, Donohue & Raymond

[57] ABSTRACT

The disclosure relates to a frame which is intended to be passed onto reinforced concrete piles which are to be cut. The frame has at least two cutter blades which are operated by piston and cylinder assemblies such that the cutter blade edges penetrate into the pile, sever the reinforcing rods and crack that portion of the pile, in the plane of penetration, which is not reached by the cutter blade edges.

6 Claims, 2 Drawing Figures

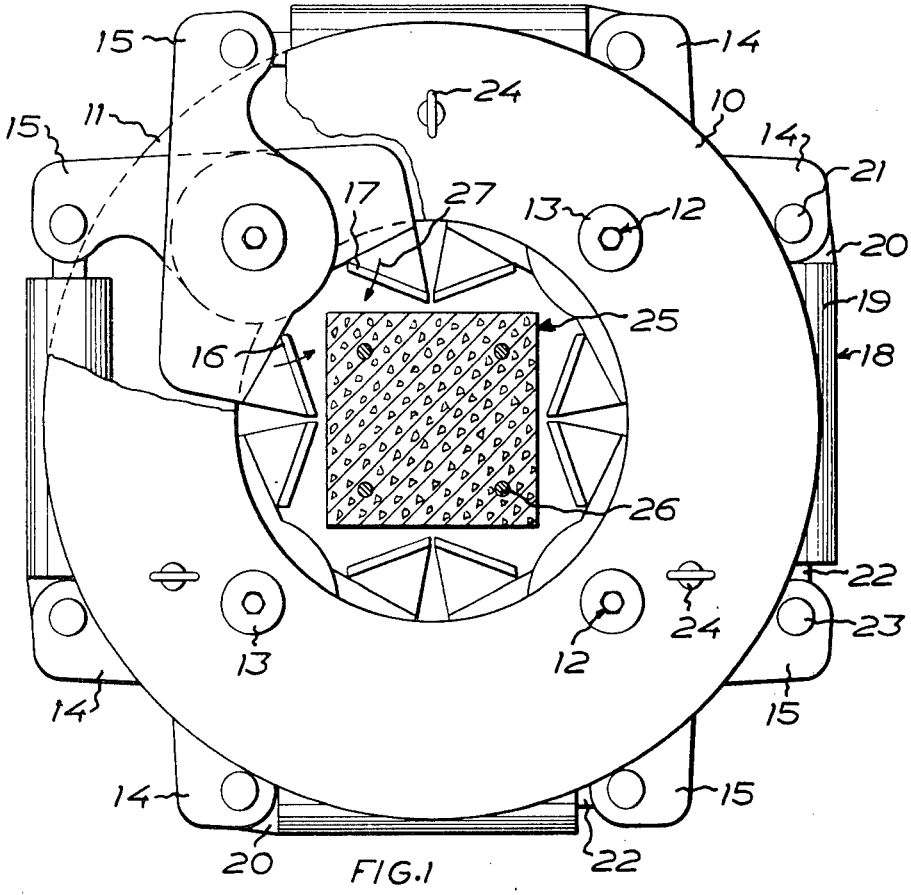
FIG.1
FIG. 2
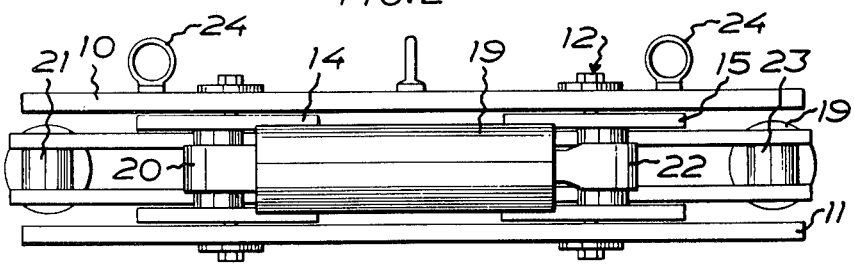

DEVICE FOR CUTTING IN PARTICULAR REINFORCED CONCRETE PILES

The present invention relates to a device for cutting in particular reinforced concrete piles.

In piling work it is often necessary that reinforced piles be cut, which, with present methods, is a troublesome and time-consuming operation, since the concrete around the reinforcing rods must be removed, the rods being then cut with a suitable tool, for example, a bolt clipper. Once the reinforcing rods have been cut, the pile can be driven into place at the intended position. It is also usual to saw off the pile by means of carborundum disks, or to blast the pile. The object of the present invention is to realize a tool by means of which the cutting operation can be effected rapidly without time-consuming manual work at the cutting position, and without often incalculable blasting operations.

According to the invention, this tool consists of a frame which is intended to be passed onto the pile, cutters mounted on the frame and being of a predetermined thickness, the cutters being shiftable towards and away from each other for engaging with and penetrating at least such portions of the pile as contain the reinforcing rods, and a piston and cylinder assembly connected to the cutters and mounted on the frame for achieving the above-mentioned shifting.

According to a preferred embodiment, the cutters are formed of at least two pairs of cutter blades, and a piston and cylinder assembly can be disposed between each pair of cutter blades with the cylinder pivotally connected to one of the cutter blades and the piston pivotally connected via a piston rod to the other cutter blade.

The nature of the present invention and its aspects will be more fully understood from the following description of the drawings, and discussion relating thereto.

In the accompanying drawings:

FIG. 1 is a top plan view of the device according to the present invention; and

FIG. 2 is a side elevation of the device of FIG. 1.

The device for cutting reinforced concrete piles consists of two flat rings 10 and 11 which are held together coaxially and in axial spaced apart relationship by means of four nut and bolt assemblies which are generally designated 12. Washers 13 are placed between the bolt heads and the nuts and the sides of the rings 10, 11 facing the nuts. The bolts 12 serve as journals for their respective pair of cutter blades 14, 15 which are placed between the rings 10 and 11. The outer ends of the cutter blades project from the space between the rings 10 and 11, whereas the inner ends of the cutter blades 14, 15 project inwardly into the annular opening, as is apparent from FIG. 1. The inner ends of the blades 14, 15 are provided with edges 16 and 17, respectively. Piston and cylinder assemblies 18 are provided for the purposes of pivoting the blades of each cutter blade pair towards and away from each other, the cylinder 19 of each assembly being pivotally connected to one cutter blade 14 in a cutter blade pair by means of a coupling piece 20 and a journal 21. Moreover, the piston rod 22 of each assembly is pivotally connected to one cutter blade 15 in the adjacent pair by means of a journal 23. As is apparent from FIG. 1, three further piston and cylinder assemblies 18 are placed between adjacent cutter blades 14 and 15 for acting upon a blade in each pair. Suspension eyes 24 are provided on the upper side of the ring 10, in which eyes lines can be fixed.

The method of use of the device shown in FIGS. 1 and 2 for cutting a reinforced, square concrete pile 24 which has reinforcing rods 26 in the vicinity of its corners, is as follows. The device is passed onto the pile from above and lowered to the cutting position by means of lines which are fixed in the suspension eyes 24 and are carried, for example, by the pile driver. All four piston and cylinder assemblies 18 are coupled, preferably by a common connection (not shown) to a suitable source of pressure medium. On supply of the pressure medium, the piston and cylinder assembly will be extended, which entails that the edged cutter blades 16, 17 in each pair of cutter blades are pivoted towards each other, as is shown by means of arrows 27 in FIG. 1. The edges 16, 17 penetrate into the concrete pile and sever each respective reinforcing rod 26. When the edges 16, 17 of the cutter blades 14, 15 have been totally moved together, the direction of the pressure medium supply is reversed and the edges are moved apart until they reach once again the initial position shown in FIG. 1. Because the cutter blades are relatively thick, they will, on penetration into the pile, crack the core of the pile (which has not been cut through) in the cutting plane. The pile will thereby be severed and the undesired portion can be removed.

It is apparent from FIG. 1 that the device according to the invention may be used for concrete piles of different dimensions. Naturally, the device can also be used for cutting polygonal and round piles in which case care must be taken to ensure that the pile is oriented such that the reinforcing rods are located in positions corresponding to those shown on the drawing.

Naturally, more or fewer than four pairs of cutter blades can be provided if necessary, and the piston and cylinder assemblies may also act between the blades in one and the same pair.

It will be apparent from the above description that the present invention provides an extremely simple aid which has long been needed in the art for cutting reinforced concrete piles.

I claim:

1. A device for cutting concrete piles and the like comprising:

(a) a frame having an opening therein to receive a concrete pile for cutting;

(b) a plurality of cutters mounted on said frame and angularly spaced apart about said opening;

(c) each of said cutters comprising a pair of opposed cutting blades mounted at the like ends of a pair of arms and extending into said opening, said arms being pivotally secured to said frame at a common point for movement towards and away from each other to move said blades towards and away from each other transversely of said opening; and (d) means to apply force to each of said pairs of arms to move said blades towards and away from each other.

2. A device according to claim 1, wherein the cutter blades of said cutters sweep segments angularly spaced apart about said opening.

3. A device according to claim 2, wherein the means to apply force to each of said pair of arms comprises piston and cylinder means connected between adjacent arms of adjacent cutters, and means for actuating said piston and cylinder means simultaneously.

4. A device according to claim 2, wherein said segments lie substantially in a common plane.

5. A device according to claim 4, wherein there are four cutters equally spaced about said opening, and wherein the means to apply force to each of said pair of arms comprises piston and cylinder means connected between adjacent arms of adjacent cutters at the ends of said arms opposite said cutter blades, each piston of said piston and cylinder means pivotally connected to one arm, and each cylinder likewise connected to another arm, and means for actuating said piston and cylinder means simultaneously.

6. A device according to claim 5, wherein said frame comprises a pair of superimposed flat rings having registering openings therein to receive a concrete pile for cutting, said rings being held in spaced-axial relation by four nut and bolt assemblies extending transversely between said rings and uniformly spaced therearound; each pair of arms of said cutters is journaled on one of said bolts; and said arms and said cutter blades are so arranged that when the arms of said pairs are moved away from each other to define an open position of the cutter blades, they lie substantially perpendicular to each other with adjacent arms of adjacent cutters substantially parallel to each other.

* * * * *